US005843567A

United States Patent [19]

Swift et al.

[11] Patent Number: 5,843,567

[45] Date of Patent: Dec. 1, 1998

[54] ELECTRICAL COMPONENT CONTAINING MAGNETIC PARTICLES

[75] Inventors: Joseph A. Swift, Ontario; Ronald F. Ziolo, Webster; Stanley J. Wallace, Victor, all of N.Y.

[73] Assignee: Xerox Corporation, Stamford, Conn.

[21] Appl. No.: 868,390

[22] Filed: Jun. 3, 1997

[51] Int. Cl.[6] ..... H01B 1/24; H01H 1/02; H01H 11/04; H01R 39/24

[52] U.S. Cl. ..... 428/221; 307/101; 307/146; 307/413; 428/293.1; 428/294; 428/295; 428/299.1; 428/323; 428/338; 428/402; 428/408; 428/900; 428/902; 29/382; 174/117 A; 174/117 FF; 174/126.2; 174/119 R; 174/110 R; 174/119 C; 361/779; 361/220; 361/221; 361/222; 361/225; 439/65; 439/86; 439/291; 439/930; 219/121.65; 200/262; 200/265; 271/258.01; 271/265.01; 310/249; 310/251; 310/253; 338/66; 338/214; 338/114; 399/168

[58] Field of Search ..... 307/101, 146, 307/413; 428/221, 293.1, 294, 295, 299.1, 323, 338, 402, 408, 900, 902; 29/382; 174/117 A, 117 FF, 126.2, 119 R, 110 R, 119 C; 361/779, 220, 221, 222, 225; 439/65, 86, 291, 930; 219/121.65; 200/262, 265; 271/258.01, 265.01; 310/249, 251, 253; 338/66, 254, 114; 399/168

[56] References Cited

U.S. PATENT DOCUMENTS

| | | | |
|---|---|---|---|
| 3,330,693 | 7/1967 | Rumberger | 117/161 |
| 4,923,739 | 5/1990 | Jin et al. | 428/211 |
| 5,139,862 | 8/1992 | Swift et al. | 428/294 |
| 5,250,756 | 10/1993 | Swift et al. | 174/119 R |
| 5,270,106 | 12/1993 | Orlowski et al. | 428/295 |
| 5,599,615 | 2/1997 | Swift et al. | 428/293.1 |

OTHER PUBLICATIONS

Swift et al., "Static Eliminator Brush Structure," *Xerox Disclosure Journal*, vol. 10, No. 2, pp. 109–110 (Mar./Apr. 1985).

*Primary Examiner*—Frederick Krass
*Attorney, Agent, or Firm*—Zosan S. Soong

[57] ABSTRACT

There is disclosed an electrical component having an axial direction and two ends for making electrical contact with another component comprising a plurality of electrically conductive fibers in a matrix, the plurality of the fibers being oriented in the matrix in a direction substantially parallel in the axial direction of the component and being continuous from one end of the component to the other end to provide a plurality of electrical point contacts at each end of the component, wherein the component further includes magnetic particles.

17 Claims, 3 Drawing Sheets

ELECTRICAL COMPONENT CONTAINING MAGNETIC PARTICLES

FIELD OF THE INVENTION

This invention relates to electrical components for making electrical contact with another component and electrical devices for conducting electrical current which include at least one of the electrical components. The electrical contact components and devices described herein, in addition to being well suited for low energy electronic/electrical signal level circuitry typified by contemporary digital and analog signal processing practices, are also particularly well suited to high power applications which require high contact power ratings and higher reliability which may rely on high bulk electrical and thermal conductivity and high surface densities of the fiber contact points in the contacts and may, for example, be used in power switching and power commutation applications.

BACKGROUND OF THE INVENTION

Typical of the type of machines which may use electrical contacts and devices are electrostatographic printing machines. In electrostatographic printing apparatus commonly used today a photoconductive insulating member is typically charged to a uniform potential and thereafter exposed to a light image of an original document to be reproduced. The exposure discharges the photoconductive insulating surface in exposed or background areas and creates an electrostatic latent image on the member which corresponds to the image contained within the original document. Alternatively, a light beam may be modulated and used to selectively discharge portions of the charged photoconductive surface to record the desired information thereon. Typically, such a system employs a laser beam. Subsequently, the electrostatic latent image on the photoconductive insulating surface is made visible by developing the image with developer powder referred to in the art as toner. Most development systems employ developer which comprises both charged carrier particles and charged toner particles which triboelectrically adhere to the carrier particles. During development the toner particles are attracted from the carrier particles by the charged pattern of the image areas of the photoconductive insulating area to form a powder image on the photoconductive area. This toner image may be subsequently transferred to a support surface such as copy paper to which it may be permanently affixed by heating or by the application of pressure, to form the desired copy.

In commercial applications of such printing machines it is necessary to distribute power and/or logic signals to various sites within the machines. Traditionally, this has required conventional wires and wiring harnesses in each machine to distribute power and logic signals to the various functional elements in an automated machine. In such distribution systems, it is necessary to provide electrical connectors between the wires and components. In addition, it is necessary to provide sensors and switches, for example, to sense the location of copy sheets, documents, etc. Similarly, other electrical devices such as interlocks, and the like are provided to enable or disable a function. These electrical devices are usually low power operating at electronic signal potentials up to 5 volts and at currents in the milliamp regime. Further, many commercial applications employ electrical contact components and related devices that require use in higher power applications employing currents in the regime of 1–100 amps and voltages greater than 5 volts. The present invention is not limited to signal level currents or low potential applications, and includes applications in higher power regimes requiring greater current carrying capacity.

Conventional electrical devices employ mechanically actuated mechanisms which include; springs, rockers, cams, and pivotal levers, for example, to provide the relative motion of opening and closing of the electrical contact elements. Often, these mechanisms are the major failure element contributing to overall device unreliability. Presently, typical functional lives of such electromechanical devices are less than about 10 million to 100 million actuations. In the electrostatographic printing machines of the future, there is a need for such devices having lives greater than 100 million actuations, and, more likely greater than 200 million actuations, and perhaps even greater than 500 million actuations. The present invention provides a means to eliminate many, if not all of the traditional mechanical mechanisms and thereby significantly improve device reliability to where device lives far in excess of 100 million actuations are possible.

Further, conventional electrical devices employ mating pairs of electrical contacts which are made from metal, or, base metal overplated with additional metals or metal alloys. High contact loads, for example 100 to 500 grams, are typically required with these metal contact systems which contribute, not only to the above-mentioned long term wear out of mechanical springs, etc., but also to the mechanical and tribological deterioration of the contact surfaces by abrasion, wear, crushing, deformation, and the like. The present invention makes it possible to substantially reduce the contact pressures required for reliable function to levels below about 100 grams, or even below about 50 grams, for example, and, to provide a means to control these lighter loads within a degree of precision that is not possible, or very expensive, with mechanical loading mechanisms.

The present invention enables the use of magnetic forces acting upon the individual electrical contact elements to move the electrical contacts in a manner that is, low cost, controllable, and highly reliable.

Other than printing or stamping identification markings or other information thereon, conventional electrical contacts are small in size and therefore spacially limited in the amount of data that can be affixed to them, either permanently, or semi-permanently. Further, the printing and stamping operations require contact to be made to the traditional metal contacts which can be a source of unwanted damage or contamination. The present invention enables a new manner of applying information to, or, more accurately, encoded therein, an electrical contact.

Conventional electrical components are disclosed in Swift et al., U.S. Pat. No. 5,599,615; Orlowski et al.,U.S. Pat. No. 5,270,106; Swift et al., U.S. Pat. No. 5,250,756; Swift et al., U.S. Pat. No. 5,139,862, and Swift et al., "Static Eliminator Brush Structure," *XEROX DISCLOSURE JOURNAL*, Vol. 10, No. 2, page 109–110 (March/April 1985).

Jones et al., U.S. application Ser. No. 08/781,304, filed Jan. 13, 1997 and now U.S. Pat. No. 5,744,090, discloses a process for the manufacture of conductive fibers usable in electrostatic cleaning devices, where magnetic, electrically conductive material is used.

Ronald Ziolo, U.S. application Ser. No. 08/600,642, filed Feb. 14, 1996 and now U.S. Pat. No. 5,667,924, discloses superparamagnetic image character recognition compositions and processes of making and using.

In addition, magnetic keys and credits cards have magnetic tape laminated to one side for encoding information.

SUMMARY OF THE INVENTION

The present invention is accomplished in embodiments by providing an electrical component having an axial direction and two ends for making electrical contact with another component comprising a plurality of electrically conductive fibers in a matrix, the plurality of the fibers being oriented in the matrix in a direction substantially parallel in the axial direction of the component and being continuous from one end of the component to the other end to provide a plurality of electrical point contacts at each end of the component, wherein the component further includes magnetic particles.

There is also provided in embodiments an electrical device for conducting electrical current comprising two contacting components, at least one of the components having an axial direction and two ends and comprising a plurality of electrically conductive fibers in a matrix, the plurality of the fibers being oriented in the matrix in a direction substantially parallel in the axial direction of the component and being continuous from one end of the component to the other end to provide a plurality of electrical point contacts at each end of the component, wherein the component further includes magnetic particles.

BRIEF DESCRIPTION OF THE DRAWINGS

Other aspects of the present invention will become apparent as the following description proceeds and upon reference to the Figures which represent preferred embodiments (Note that the figures are not drawn to scale and that "N" indicates north and "S" indicates south).

Unless otherwise noted, the same reference numeral in different Figures refers to the same or similar feature.

DETAILED DESCRIPTION

Figure 1:
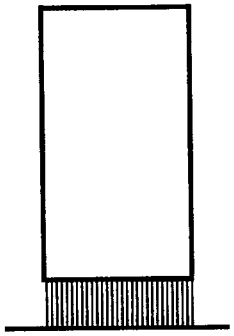
FIG. 1 is a side view illustrating an electrical component having a brush structure formed by removal of the matrix from one end region to expose the individual fibers wherein the exposed fibers in the brush structure are relatively long compared to the fiber diameter and will behave as a brush-like mass when deformed.

The following terms and phrases have the indicated meanings:

"electrical component" encompasses low, intermediate, and high current devices;

"matrix" refers to a binder material; and

"fibrillation" and "fibrillated" refer to the process of selective removal of the matrix encasing the fibers in the electrical component. A substantial portion of the matrix, preferably all of the matrix, is removed; by use of heat, solvents, or abrasion, for example from an end region of the electrical component to form the fiber rich surface comprising the contact region. Thus, in embodiments, an end region of the electrical component is at least substantially free of the matrix, preferably totally free of the matrix, to form the fiber rich brush structure.

In accordance with the present invention, an electrical component is provided and a variety of electrical devices for conducting electrical current such as switches, sensors, connectors, interlocks, etc. are provided which are of greatly improved reliability, are of low cost and easily manufacturable and are capable of reliably operating at low contact loads in a wide variety of circuits. Typically these devices are low energy devices, using voltages within the range of millivolts to kilovolts and currents within the range of microamps to hundreds of milliamps as opposed to high power applications of hundreds to thousands of amperes, for example. Although the present invention may be used in certain applications in the one to tens of amps region, it is noted that best results are obtained in high resistance circuitry where power losses attributable to the subject devices can be tolerated. It is also noted that these devices may be used in certain applications in the very high voltage region in excess of 10,000 volts, for example, where excessive heat is not generated or can be controlled to an accepted level. These devices are generally electronic in nature within the generic field of electrical devices meaning that their principle applications are in low to moderate energy and signal level circuits. Furthermore, it is possible for these electrical devices in addition to performing an electrical function to provide a mechanical or structural function, such as a column beam, lever arm, leaf or other type of spring, recesses, grooves, slides, snap fits, and the like . The above advantages are enabled through the use of a manufacturing process known generally as pultrusion and the fibrillation of at least one end region of the pultrusion.

According to the present invention, an electrical component is made by pultrusion or another suitable technique and an end region is fibrillated to create a fiber rich structure at one end which provides a densely distributed filament contact which is highly suited for electrical mating with another component across a separable interface. By the term densely distributed filament contact it is intended to define an extremely high level of contact redundancy insuring electrical contact with another contact surface in that the contacting component has in excess of 1000 individual conductive fibers per square millimeter. In a preferred embodiment, with the use of a laser, for example, an industrial 500 watt $CO_2$ laser, the pultruded member can be cut into individual segments and heat fibrillated in a one step process. The laser cutting and fibrillating process provides a quick, clean, programmable process for producing a soft, compliant, fiber rich electrical contact which is of low cost, highly reliable, and long life. Likewise, this process produces contacts that generate low electrical noise, do not shed and can be machined like other solid materials and yet provides a long wearing, easily replaceable, and non-contaminating conductive contact. In a second, preferred embodiment a narrow, high pressure waterjet cuts the pultruded member with the abrasive action of a high velocity water stream without heating of the member. This process produces a fiber rich contact surface where the tips of the fibers are on an equal plane with the matrix resin and results in a relatively hard, non-compliant, fiber rich contact surface.

On the one hand the laser process when adjusted to cut and fibrillate deeply into the pultrusion material, has the capability of producing an electrical contact wherein the filaments of the brush structure have a length many times greater than their diameter and thereby provides a soft, resiliently flexible brush which behaves elastically when it is deformed thereby providing with the large number of filaments, the desired level of redundancy and with the large degree of resiliency, the softness desired in a long life, high reliability electrical contact. On the other hand, the waterjet process, as well as other variants of the laser process can produce a micro-like structure wherein the fibers of the contact surface have a length much shorter than five times the diameter of the fibers and provide a relatively hard, rigid contacting surface. In embodiments of the present invention, no, or little, matrix is removed from either end region of the electrical component where the matrix material extends to the ends of the component.

The pultrusion process generally consists of pulling continuous lengths of fibers through a resin bath or impregnator and then into a preforming fixture where the geometric cross-section is initiated and excess liquid, or powder resin and air are removed and then into a progressively heated die where the sectional shape is cured continuously. Typically, the process is used to make fiber reinforced plastic, pultruded shapes. The "Handbook of Pultrusion Technology" by Raymond W. Meyer, first published in 1985 by Chapman and Hall, New York, provides a detailed discussion of pultrusion technology, the disclosure of which is totally incorporated herein by reference. In the practice of the present invention, conductive carbon fibers are submersed in a liquid polymer bath and drawn through a die opening of suitable shape at high temperature to crosslink the liquid polymer and thereby produce a solid piece of dimensions and shapes of the die which can be cut, shaped, and machined into a desired electrical component. As a result of this pultrusion process, thousands of conductive fiber elements are contained within the polymer matrix whose ends can be exposed to provide electrical contact surfaces using the above-described laser and waterjet cutting methods. This high degree of redundancy and availability of electrical point contacts to function independently enables a substantial improvement in the reliability of these devices. Since the plurality of small diameter conductive fibers, in the form of muli-filament carbon fiber tows, are pulled through the polymer bath and heated die as a continuous length, the shaped component is formed with the fibers being continuous from one end of the component to the other and oriented within the resin matrix in a direction substantially parallel to the axial direction of the component. By the term "axial direction" it is intended to define a lengthwise or longitudinal direction along the major axis of the configuration produced by the pultrusion process. Accordingly, the pultruded composite may be formed in a continuous length of the configuration during the pultrusion process and cut to any suitable dimension providing at, more than one location a very large number of electrical point contacts. These pultruded composite components may have either one or both of the ends subsequently fibrillated.

Magnetic particles can be incorporated into the matrix, the fibers, the optional overcoating on the fibers, the optional overcoating on the pultrusion, or a combination thereof by the following preparation techniques. As a preferred embodiment, the present invention involves the use of high shear blend mixing of small particle size, magnetic filler directly into the resin prepolymer. Any suitable magnetic particles, such as soft ferrites, hard ferrites (such as strontium, lead, barium), neodymium iron boride, nickel, and cobalt alloys, and the like, having any suitable particle size, such as 1 nanometers to 10 micrometers, and shape, such as spherical, round, or cylindrical, or mixtures of sizes and shapes may be used in suitable concentration to render the desired magnetic properties in the resultant compositon. While magnetic particle concentrations of between 0.01 and 500% based upon the weight of the resin may be used, consideration of the optimum ratio involves the tradeoff amongst magnetic effect, loss of mechanical strength of the composite, increase in density of same, and cost. Thus, the preferred embodiment employs the minimum amount of magnetic particulate filler, for example less than 200% by weight, or preferable less than 50% of the polymer. These loadings are based upon the initial weight of polymer which is a convention used in the composites industry. Importantly, these concentrations will equate to lower overall loadings once the polymer is composited with the fiber and other components of the final composite. The mixture of magnetic particles, liquid crosslinking polymer resin, and suitable catalyst is then used as the resin bath for a typical pultrusion process where, as described above, continuous carbon fiber is impregnated with the resin mixture containing magnetic material and formed into a solid composite structure, which can then be processed into a suitable distributed filament contact.

An alternate embodiment uses a mixture of magnetic particles and a suitable polymer and solvent. The liquid mixture is spray, dip, or immersion coated onto the fibers, and allowed to dry prior to entry into the pultrusion process. Another option involves coating of the polymer, solvent, and magnetic filler mixture onto the solid pultruded structure after it emerges from the pultrusion process. This option can be further modified to subject the coating to a magnetic field before the solvent has been removed by drying. The field in this case serves to create structural alignment and orientation of the very fine magnetic particulate material into, for example, multiparticulate columnar structures where each individual column of magnetically aligned particulate material parallels another similar column in very close proximity and is oriented perpendicular to the solid pultrusion. The dimensions of a typical column would be, for example, about 2 nm to about 50 nm in diameter and about 1 to about 50 microns in height. The array of aligned columns can be preserved upon drying of the coating to form the solid overcoating. Clearly, the use of the smallest particle size filler, namely about 2 nm, aligned in the described manner, produces a coating with extremely high fill density of aligned magnetic filler. Theoretically, the fill density can approach about $3\times10^6$ particles per square millimeter enabling the resultant encoded information to be of extremely high density. The densities obtained in this manner are substantially greater than those employed in existing magnetic keys and credit cards which employ laminated tape containing the magnetic material. Other column densities and orientations are possible by control of the filler size and shape as well as the magnetic field during drying of the coating.

A further option utilizes electrostatic spray or dry powder coat application of the magnetic particulate material in the form of a fine solid powder directly onto the fibers at a point immediately before entry into the putrusion process. Likewise, addition of the magnetic particulate filler directly into the polymer that is the parent to the carbon fiber at a point prior to formation of the carbon fiber would provide fibers with suitable magnetic properties. In this case care must be given to the selection of a magnetic filler that is of high thermal stability to withstand the temperatures present during carbonization of the fiber. Another option is the use of thin strips of magnetic recording tape, such as that typically used for audio casette and video recorders, in continuous lengths and co-pultrude the magnetic stip material along with the carbon fiber filler during the pultrusion manufacturing process. Combinations of these options are also possible and desirable in some cases. For example, where the maximal amount of magnetic filler is required in the end-product pultrusion, magnetic filler would be added during the manufacture of the carbon fiber to include the filler within the fiber's sturcture as well as coated thereon, magnetic particulate would be mixed within the pultrusion resin, and lastly would be coated upon the pultrusion to yield additional increments of magnetic filler to the overall composition.

Any suitable fiber may be used in the practice of the present invention. Typically, the conductive fibers are nonmetallic and have a DC volume resistivity of from about $1\times10^{-5}$ to about $1\times10^{11}$ ohm-cm and preferably from about $1\times10^{-4}$ to about 10 ohm-cm to minimize resistance losses and suppress RFI. The upper range of resistivities of up to $1\times10^{11}$ ohm-cm could be used, for example, in those special applications involving extremely high fiber densities where the individual fibers act as individual resistors in parallel thereby lowering the overall resistance of the pultruded component enabling current conduction. The vast majority of applications however, will require fibers having resistivities within the above stated preferred range to enable current conduction. The term "nonmetallic" is used to distinguish from conventional metal fibers which exhibit metallic conductivity having resistivity of the order of $1\times10^{-6}$ ohm-cm and to define a class of fibers which are nonmetallic but can be treated in ways to approach or provide metal like properties, which include electrical conductivity and magnetic activity. Higher resistivity materials may be used if the impedance of the associated electrical circuit is sufficiently high. In addition, the individual conductive fibers are generally circular in cross section and have a diameter generally in the order of from about 4 to about 50 micrometers and preferably from about 7 to 10 micrometers which provides a very high degree of redundancy in a small cross sectional area. The fibers are typically flexible and compatible with the matrix. Typical fibers include carbon and carbon/graphite fibers but may include metal particle filled- or metal plated-glass, ceramic, and organic fibers.

A particularly preferred fiber that may be used are those fibers that are obtained from the controlled heat treatment processing to yield complete or partial carbonization of polyacrylonitrile (PAN) precursor fibers. It has been found for such fibers that by carefully controlling the temperature of carbonization within certain limits that precise electrical resistivities for the carbonized carbon fibers may be obtained The carbon fibers from polyacrylonitrile precursor fibers are commercially produced by Graphil, Inc., Amoco Performance Products, Inc., and others in yarn bundles of 1,000 to 160,000 filaments commercially referred to as "Tows." Metal plated carbon fibers are available from Novamet Specialty. The Tows are typically carbonized in a two-stage process. The first stage involves stabilizing the melt spun and drawn PAN fibers at temperatures of the order of 300° C. in an oxygen atmosphere to produce "preox" PAN fibers ("preox" is the intermediate fiber resulting from this first stage of processing; it is black in color, relatively large in diameter, and nonconductive) followed by carbonization at elevated temperatures in an inert (nitrogen) atmosphere. The DC electrical resistivity of the resulting fibers is controlled by the selection of the temperature of carbonization. For example, carbon fibers having D.C. resistivities of $10^{-2}$ to about $10^{-6}$ ohm-cm result from treatment temperatures of up to 1800° to 2000° C. For further reference to the processes that may be employed in making these carbonized fibers, attention is directed to U.S. Pat. No. 4,761,709 to Ewing et al. and the literature sources cited therein at column 8. Typically these carbon fibers have a modulus of from about 30 million to 60 million psi or 205–411 GPa which is higher than most steels thereby enabling a very strong pultruded composite component. The typical high temperature conversion of the polyacrylonitrile fibers results in a fiber which is about 99.99% elemental carbon which is inert and will resist oxidation. Of course, the addition of fine, magnetic particulate filler directly within the fiber as described as an option earlier can alter these characteristics. For example, if ferrite is used as the filler, a decrease in the final carbon concentration equal to the amount of filler which is primarily iron and oxygen will result. Clearly, the choice of fillers must take into account the process temperatures that will be encountered in producing the final product. Where the highest temperatures will be encountered, for example to produce carbon fibers having the highest conductivity, nickel or strontuim may be better choices than ferrites as the oxygen component therein may not withstand the process conditions and may adversely affect the resultant strength of the carbon fiber. The fiber may be an Amoco THORNEL™ carbon fiber such as T300™ and T650™ PAN.

One of the advantages of using conductive carbon fibers is that they have a negative coefficient of thermal conductivity so that as the individual fibers become hotter with the passage of, for example, a spurrious high current surge, they become more conductive. This provides an advantage over metal contacts since metals operate in just the opposite manner and therefore metal contacts tend to weld, burn out, or self destruct. The carbon fibers have the further advantage in that their surfaces are inherently rough and porous thereby providing better adhesion to the matrix. In addition, the inertness of the carbon material yields a contact surface relatively immune to corrosion when compared to most metals.

Any suitable matrix may be employed in the practice of the present invention. A metallic matrix can be used as described in Swift et al., U.S. Pat. No. 5,599,615, the disclosure of which is totally incorporated herein by reference. The matrix may be insulating or conducting. If cross directional electrical conduction is desired along the edges of the pultrusion a conducting polymer may be used. Conversely, if insulating properties are desired along the edges of the pultrusion, a thick layer of an insulating polymer may be used, or insulating fibers can be used in the outer periphery of the pultruded configuration and the conducting fibers can be configured to reside away from the edges.

Typically, the matrix is selected from the group of thermoplastic and thermosetting resins. Polyesters, epoxies, vinyl esters, polyetheretherketones, polyetherimides, polyethersulphones, polypropylene and nylon are in general, suitable materials with the epoxies, polyesters, and vinylesters being preferred due to their short cure time, relative chemical inertness, compatibility with the magnetic fillers, and suitability for waterjet and laser processing. If an elastomeric matrix is desired, a silicone, fluorosilicone or polyurethane elastomer may be used as the polymer matrix. Typical specific materials include HETRON 613™, HETRON 980™, ARPOL 7030™ and ARPOL 7362™ available from Oshland Oil, Inc., DION ISO 6315™ available from Koppers Company, Inc. and SILMAR S-7956™ available from Vestron Corporation. Other matrix resins include: EPON 9405™/9470™ which is a modified bisphenol A epoxy resin (Shell Chemical Co.); RSL-2384™ which is a modified epoxy (Shell Chemical Co.); ATLAC 580™ which is a urethane modified bisphenol vinyl ester (Reichhold Chemical Inc.); and DERAKANE 411™, 441-400™, 470™, 510™, 8084™ are all epoxy vinyl esters (Dow Chemical Co.). For additional information on suitable resins, attention is directed to Chapter 4 of the above-referenced Handbook by Meyer. Other materials may be added to the matrix bath to provide their properties such as lubricants, corrosion resistance, adhesion enhancement, or flame retardancy as desired. In addition, the polymer bath may contain fillers such as calcium carbonate, alumina, silica or pigments to provide a certain color, texture, or lubricants to reduce friction, for example, in sliding contacts. Further additives to alter the viscosity, surface tension or to assist in cross linking or in bonding the pultrusion to the other materials may be added. Naturally, if the fiber has a sizing applied to it, a compatible polymer should be selected. For example, if an epoxy resin is being used, it would be appropriate to add an epoxy sizing to the fiber to promote adhesion between the resin and the fibers.

The fiber types and loadings in the polymer matrix depends upon the conductivity desired as well as on the cross-sectional area and other mechanical, physical, and magnetic properties of the final configuration. Typically, the matrix has a specific gravity of from about 1.1 to about 1.5 while the fibers have a specific gravity of from about 1.7 to about 2.2. Typically, very high fiber concentrations, for example greater than 50% by weight and often greater than 75% by weight, are characteristic of the pultrusion process which requires a minimum overall fiber loading determined by factors such as; the shape, size and complexity of the pultruded component as well as the polymer type and viscosity, die design, process velocity and temperature. While the carbon fibers may be present in amounts as low as 1 to 5% by weight of the pultruded component to control the electrical conductivity of the composite at a prescribed low level, for example $1\times10^{-1}$ ohm-cm, other fibers, such as fiberglass fibers must be added to comprise the minimum requirements called for by the pultrusion process. In general, pultrusions with high loadings of carbon fiber are preferred to provide pultruded composites with high electrical conductivities.

In embodiments, the electrical component includes Amoco T300™ carbon fiber sized with Amoco UC-309™ resin, MODAR 826HT™ (believed to contain an acrylic modified polyester) as the matrix available from ICI, plus a small amount of a suitable lubricant such as polyethylene wax and a curing agent such as Noury PERCADOX 16N™. In other embodiments, the electrical component includes Amoco T300™ carbon fiber sized with Amoco UC-309™ resin, GP442D35 RESI-SET™ (believed to contain a phenolic compound) as the matrix available from Georgia Pacific, without any external catalyst, and a small amount of a suitable lubricant such as polyethylene wax.

The pultruded composite components may be prepared according to the pultrusion technique as described, for example, by Meyer in "Handbook of Pultrusion Technology." In general, this will involve the steps of pre-rinsing the continuous multi-filament strand of conductive carbon fibers in a pre-rinse bath followed by pulling the continuous strand through the molten or liquid polymer which contains the particulate magnetic filler in a contiuously mixing vessel followed by pulling it through a heated die which may be at, or above, the curing temperature of the resin into an oven dryer if such is necessary to a cut-off or take-up position. For further and more complete details of the process attention is directed to Meyer. The desired final shape of the pultruded composite component may be that provided by the die. Typically, the cross section of the pultrusion may be round, oval, square, rectangular, triangular, etc. In some applications, it can be irregular in cross section or can be hollow like a tube or circle having the above shapes. Other configurations allowing mixed areas of conducting and non conducting fibers as well as mixed areas of magnetic and no magnetic fillers are also possible. The pultrusion is capable of being machined with conventional carbide tools according to standard machine shop practices. Typically, holes, slots, ridges, grooves, convex or concave contact areas or screw threads may be formed in the pultruded composite component by conventional machining techniques. Alternatively, the pultrusion process may be modified such that when the pultrusion is initially removed from the die it is pliable and can be bent or otherwise shaped to a form which upon further curing becomes a rigid structural member. Alternatively, if the pultrusion resin is a thermoplastic the process can be adjusted such that the part is removed hot from the die, shaped, then cooled to solidify.

Typically, the fibers are supplied as continuous filament yarns having, for example, 1, 3, 6, 12 or up to 160 thousand filaments per yarn. Typically the fibers provide in the formed pultruded component from about $1\times10^{3}$ (a nominal 10–12 micrometer diameter fiber at 70–75% by weight loading in the pultrusion) to about $1\times10^{7}$ (a nominal 4 micrometer diameter fiber at 90% by weight loading in the pultrusion) point contacts per $cm^2$.

The electrical component having the high redundancy electrical contact surface of individually acting fibers may be fibrillated by any suitable technique. Typical techniques for fibrillating the pultruded component include solvent and heat removal of the polymer matrix at the end of the pultruded component. In a preferred embodiment, fibrillation is carried out by exposure to a laser beam. In the heat removal processes the polymer matrix should have a significantly lower melting or decomposition point than the fibers. Similarly in solvent removal processes, the solvent should remove the polymer matrix only and be a nonsolvent for the fibers. In either case the removal should be substantially complete with no significant amount of residue remaining. Typically the pultruded member is supplied in a continuous length and is formed into a fibrillated contact of much smaller dimension so that the laser is used to both cut individual components from the longer length and at the same time fibrillate both severed ends providing a high redundancy fiber contact for the advanced pultruded component downstream and a high redundancy fiber contact on the upstream end of the second pultruded component. Typically, the lasers employed are those which the polymer matrix will absorb and thereby volatilize. They should also be safe, have high power for rapid cutting having either pulsed or continuous output and be relatively easy to operate. Specific lasers include a carbon dioxide laser, or a carbon monoxide laser, a YAG laser or an argon ion laser with the carbon dioxide laser preferred as it is highly reliable and best suited for polymer matrix absorption and to manufacturing environments and is most economical. The following example illustrates the invention.

Pultrusions in the shape of a rod 2.5 mm in diameter made from carbon fibers about 8 to 10 micrometers in diameter and having a resistivity of 0.001 to 0.1 ohm-cm present in a vinyl ester resin matrix to a density greater than 10,000 fibers per $mm^2$ were exposed to an (Adkin Model LPS-50) laser focused to a 0.5 mm spot, 6 watts continuous wave while the rod was slowly rotated about the rod axis at about 1 revolution per second. After about 100 seconds of exposure in one step the laser cleanly cut the pultrusion and uniformly volatilized the vinyl ester binder resin up to a few millimeters from the filament end (of both pieces) leaving an "artist brush" tip connected to the rigid conducting pultrusion as shown in FIG. 1. Furthermore, while the preferred embodiment has been described with reference to a one step laser cut and fibrillating process, it will be understood that the cutting and fibrillating steps may be performed separately and in succession.

Using a larger $CO_2$ laser (Coherent General model Everlase 548) operating at 300 watts continuous wave and scanning at about 7.5 cm/mm a 1 mm diameter pultrusion made from the same materials was cut and fibrillated in less than one second.

Figure 2:
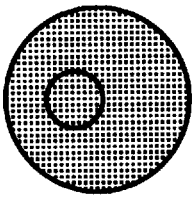
FIG. 2 is an end view of the electrical component of FIG. 1.
Figure 3:
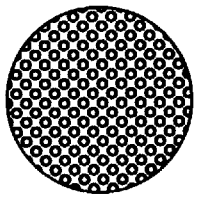
FIG. 3 is a further enlarged magnified view of the designated portion of the end view of FIG. 2, where there is illustrated the fibers in close packed array.

Attention is directed to FIGS. 2 and 3 which illustrate a preferred embodiment of an electrical component according to the present invention having a fibrillated brush structure at one end region of the composite component which provides a densely distributed filament contact with an electrically contacting surface. With the above-described composite component it will be understood that the brush structure has a fiber density of at least 1000 fibers/$cm^2$ to provide the high level of redundancy of electrical contact. It will be appreciated that such a level of fiber density is not capable of being accurately depicted in FIG. 2, and FIG. 3. FIG. 1 however, does illustrate that the fibers of the brush structure have a substantially uniform fiber length and that there is a well defined zone of demarcation between the brush structure and the portion of the composite component including the matrix which is enabled through the precision control of the laser, the water jet, or the acid etch process, which can selectively remove the matrix from the end region.

FIG. 1, FIG. 2 and FIG. 3 illustrate an electrical component wherein the fibers of the brush structure have a length much greater than five times the fiber diameter and are therefore generally resiliently flexible behaving elastically as a mass when deformed. This type of electrical component would find utility in those applications where it is desirable to have a contact of resiliently flexible fibers such as a sliding contact, commutator brush. In these contacts it should be noted that the individual fibers are so fine and resilient that they will stay in contact with another contacting surface and result in a low contact resistance even at low contact loads of as little as 5 to 50 grams. Therefore they can experience bounce without disruption of the electrical contact such as frequently may happen with traditional metallic contacts. Accordingly, they continue to function despite minor disruptions in the physical environment such as bounce and vibration. This type of macro fibrillation is to be distinguished from the more micro fibrillation wherein the length of fiber extending beyond the matrix resin is minimal and wherein the fibers in the brush structure have a length shorter than about five times the fiber diameter and the terminating ends provide a relatively rigid and nondeformable contacting surface. With this component, there will be a minimal deflection of the individual fibers and this configuration will therefore find utility in applications requiring stationary or nonsliding, mateable contacts such as in switches, sensors, and connectors. Nevertheless, the micro embodiment provides a highly reliable contact providing great redundancy of individual fibers defining the contacting surface. It is particularly important in this micro embodiment that a good zone of demarcation between the matrix section and the brush structure be maintained to provide a clean, resin-free contact and mating face with the other surface.

The phrase zone of demarcation refers to that portion of the composite component between where the matrix is fully or mostly removed from the contact region and the section of the composite where no matrix material has been removed. The particular matrix removal process employed affects the gradation of the remaining matrix material in the zone of demarcation. In the zone of demarcation created by the 6 W and 300 W $CO_2$ lasers described above, a small volume of the component is raised substantially in temperature upon contact with the light induced heat produced by the laser. The heat is hot enough to initiate cutting of the carbon fiber as well as decomposition and vaporization of the matrix resin and fiber. The heat spreads from the hot, initial contact zone to the colder bulk of the composite material due to the thermal conductivity of the material, energy in the laser spot, and time of exposure. The temperature profile along the length of the component created during the dynamic heating results in a gradation of decomposed and vaporized matrix material within the zone of demarcation. Alternately, the waterjet cutting process does not induce heat into the component, instead, it employs the abrasive action of a fine, high velocity stream of water to effect cutting of the material. The abrasion, not only cuts through the component but also tends to remove the resin from the fiber tips and a very short distance along the fiber creating a very small demarcation zone.

As used herein, the phrase "free fiber length" refers to the length of the fibers in the brush structure of the composite component from which the matrix resin has been removed. Any suitable free fiber length up to an inch or more may be used. However, a free fiber length greater than about 5 to 10 millimeters may be impractical as being too costly to both remove and waste the matrix compared to other conventional assembly techniques for brush structures. For electrostatic and other electrical and electronic applications a free fiber length of from about 0.005 to about 3 millimeters is preferred. In the micro embodiment, where the free fibers are for example less than about 10 microns in diameter, the contact end is relatively hard and thereby feels like a solid to the touch because the fibers are too short to be distinguished from the component. However, in the macro embodiment where the free fiber length is greater than about 0.25 mm, the fibrillated contact end is soft and feels like a fuzzy velour or artist's brush.

The fibrillated component with subject magnetic properties may be used to provide at least one of the contacting components in a device for conducting electrical current, the other contacting component being selected from conventional conductors and insulators. In addition or alternatively, both of the contacts may be made from similar or dissimilar inventive composite components and inventive fibrillated composite components. Alternatively, one contact may be a composite component but not fibrillated. One contact may be macro fibrillated and the other micro fibrillated and one, or both, may contain the magnetic material of the present invention. Furthermore, one or both of the electrical components may provide a mechanical or structural function. For example, in addition to performing as a conductor of current for a connector, the solid portions (i.e., containing the matrix) of a fibrillated composite component may also function as a mechanical member such as a bracket or other structural support or as a mechanical fastener for a crimp on a metal connector or may be flexible and act as a spring or lever member. A portion of a fibrillated composite component, in addition to the magnetic features, may provide mechanical features such as a guide rail or pin or stop member or as a rail for a scanning head to ride on and also provide a ground return path while providing a magnetic force that may act upon another component, or components, such as in a position sensor or break. Accordingly, functions can be combined and parts reduced and in fact a single piece can function as electrical contact, magnetic actuator, and structural support member for itself and an electrical connection.

Figure 4:
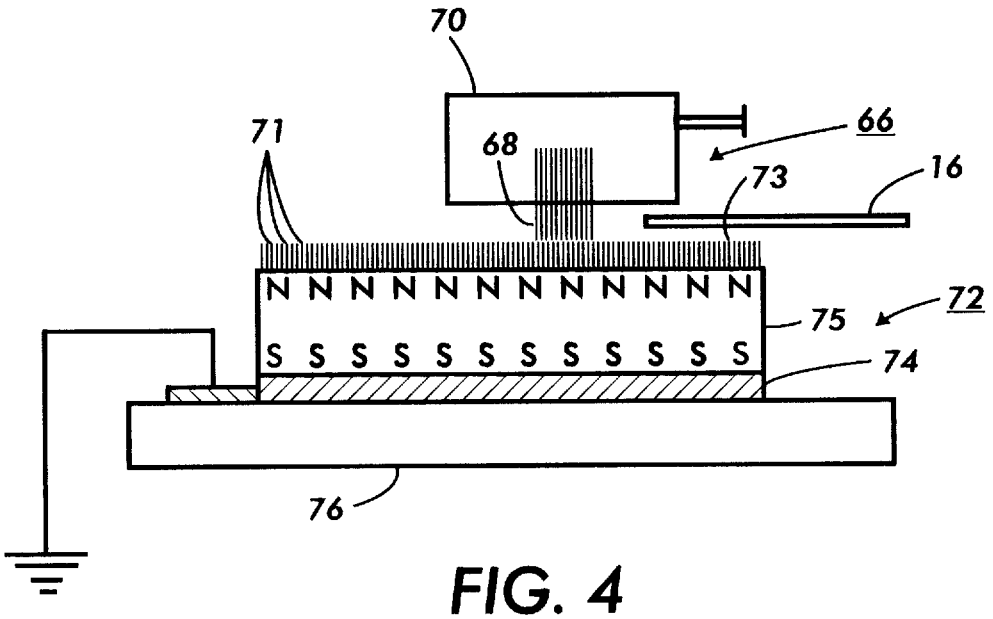
FIG. 4 is a representation of a sensor having a pair of oppositely disposed electrical components which are subjected to the forces of a magnetic field.

With reference to FIG. 4, there is shown in a path of movement of a document 16 through a document sensor device 66. The document sensor 66 generally includes a pair of oppositely disposed conductive contacts. One such pair is illustrated as a fibrillated brush having magnetic material, such as a nickel metal plating upon, or very fine nickel particles contained within, the electroconductive fibers 68 carried in upper support 70 in electrical contact with composite component 72 carried in lower conductive support 74 which is mounted on base 76. The lower composite component comprises a plurality of conductive fibers 71 in a matrix comprising the magnetic particle filled resin 75 configured into a magnetically polarized permanent magnet as shown. Fibrillation of the contact end is performed to define surface 73 comprised of free fiber tips with the one end of the fibers being available for contact with the fibers of the fibrillated brush 68 which is mounted transversely to the sheet path to contact and be deflected by passage of a document between the contacts. When no document is present, the fibrillated brush fibers 68 form a closed electrical circuit with the surface 73 of the composite component 72. The magnetic force provided between fibers 68 and surface 73 serves to return the fibers to the position shown immediately after passage of the document which enables a response that very accurately reflects the exact location of the trailing edge of the document and does so without contact bounce, vibration, or other drift which can cause spurious and errorenous signals. Thus the reliability and precision of this sensor device are improved with the present invention.

Figure 5:
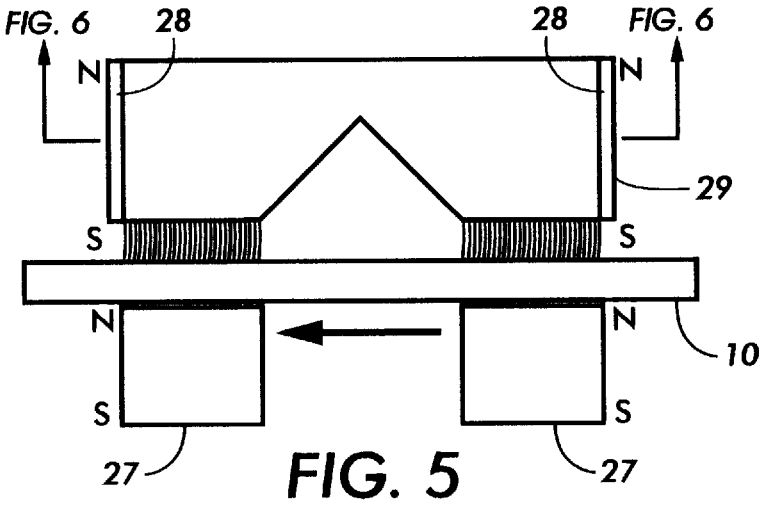
FIG. 5 is an enlarged view from the side of a photoconductor grounding brush in contact with a moving photoconductor surface. It illustrates the photoconductor grounding brush having an opposing permanent magnet which is magnetically polarized to provide an attractive force on the fibers of the subject device.

Attention is directed to FIG. 5 wherein a side view schematic of a photoconductor grounding brush 29 is illustrated with the photoconductor 10 moving in the direction indicated by the arrow. A notch or "V" is formed in the matrix portion of the grounding brush since the moving photoconductor belt can have a seam across the belt which is insulative at its apex and thereby would potentially disrupt the grounding operation by lifting the grounding brush off of the conductive region of the photoconductor. To avoid this problem, this geometry provides two fibrillated brush structures which are separated by the space of the notch or "V". The conductive or semi-resistive fibers of this device contain sufficient magnetic filler to render the fibers magnetically polarized in the direction indicated. Permanent or electomagnets 27 are positioned below and opposing the individual brush surfaces and are magnetically polarized as shown. The force of the magnetic field is adjusted to exert a constant contact load of between 5 and 25 grams on each of the brush surfaces and does so even in the presence of bounce imposed by passage of the seam bump and other surface irregularities that may be present on the surface of the moving photoconductor 10.

Figure 6:
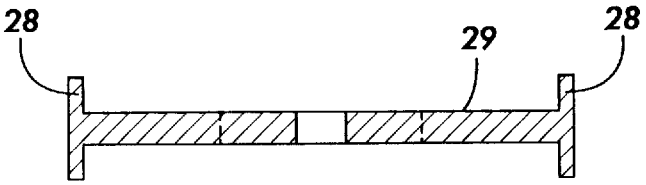
FIG. 6 is a top view of the photoconductor grounding brush of FIG. 5 which illustrates structural features along each end.

Referring to FIG. 6 which is a top view of the component of FIG. 5 and illustrates incorporation of rails 28 as structural features running lengthwise along each side of the component. The rails serve to position and align the component in a similar mating-shaped bracket (not shown) which allows the component to slide easily in the plane along the length dimension. This arrangement allows the electrical brush surface to remain in perpendicular alignment with the surface of the photoreceptor under a contact load that is controlled by the magnetic forces shown in FIG. 5 and to reliably serve as a sliding contact against the moving photoreceptor surface.

Figure 7:
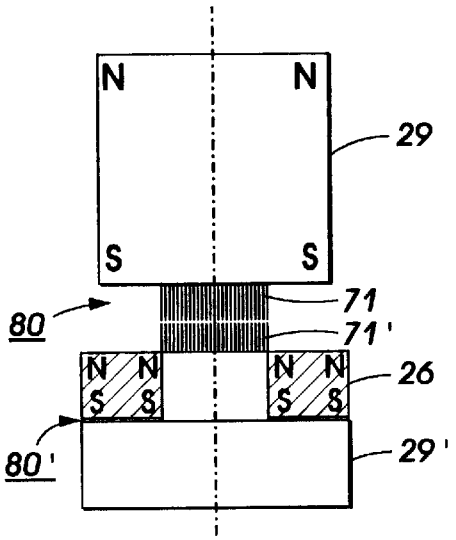
FIG. 7 is a representation of a rod shaped electrical contact element within an electromagnetic field, where the electromagnetic field provides the force necessary to act upon the magnetic filler within the electrical component.

Attention is directed to FIG. 7 illustrating a side view schematic of a pair of electrical contact components (29, 29') that are rod shaped and the mating contact surfaces (71,71') have been prepared by a laser cutting process creating a hard contact surface with very short free fiber lengths. In FIG. 7, the uppermost component contains magnetic filler within the matrix resin of the composite which has been magnetically polarized as shown. Recesses (80,80') have been cut into the circumferences of both which permit a circular electromagnet 26 to be permanently affixed on the lower component which is rigidly mounted to an appropriate support member such as a housing, not shown. Since the lower component does not contain the magnetic filler no magnetic field exists between the lower electrical component and the electromagnet. A suitable magnetic field is created between the electromagnet and the recessed portion of the upper componet to cause actuation and movement of the upper component, which is contained within an external mounting that is not shown, to come into precise alignment and intimate contact with the lower component thereby closing the electrical circuit and allowing current flow across the interface. Upon reversal of the field of the electromagnet, separation of the components occurs with opening of the electric circuit. The electrical magnet is controlled to deliver only the minimal level of magnetic field to cause the movments and contacting actions described. Thus, in embodiments of the electrical device including two contacting components, there may be a magnet coupled to one of the components.

Figure 8:
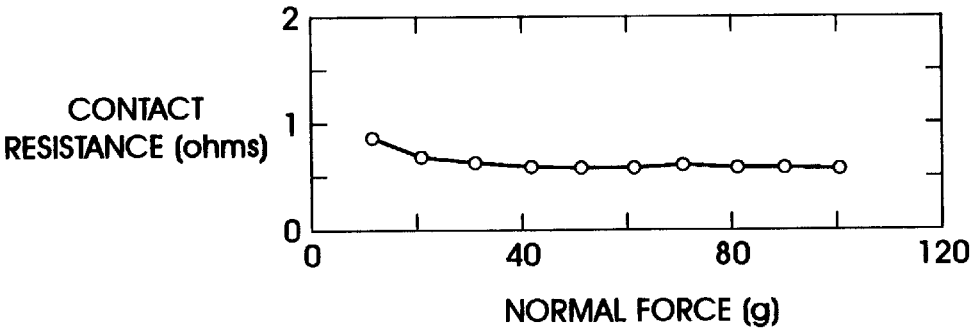
FIG. 8 illustrates the contact resistance as a function of imposed load for a typical, long free fiber length, electrical contact of the present invention.

FIG. 8 is a graphical representation of the contact resistance behavior as a function of the applied contact load for a pair of conventional electrical components having a fibrillated brush structure at one end of each component which, importantly, illustrates that low and stable contact resistances are obtained at loads of as little as 5 to 10 grams which are easily provided by magnetic forces. In embodiments of the present invention, the contact load created by the inventive electrical component with another same or different electrical component may range for example from about 1 g to about 100 g, preferably less than 100 g, and more preferably less than about 50 g.

Figure 9:
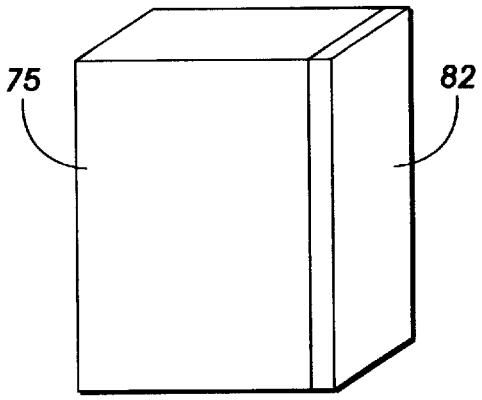
FIG. 9 is a perspective view of another embodiment having magnetically recorded information within the electrical contact element.

Attention is drawn to FIG. 9 illustrating a flat bar shaped electrical component 75 and inclusion of a magnetic filler contained in an overcoating layer 82 along at least one edge, upon which magnetically encoded information may be placed by use of an appropriate magnetic recording device, not shown and permanently stored for retrieval at a later time by passage under a suitable magnetic reading device, not shown. The binder for the overcoating layer 82 may be the matrix material described herein. The magnetic particles can be aligned in an array of columns within the coating layer by subjecting the particles to a magnetic field prior to drying of the solvent from the coating layer, afterwhich, the particulate alignment is frozen into the solid overcoating layer. Thus, in embodiments, the magnetic particles are included in a coating on a portion of the surface of the electrical component, at extremely high densities, not previously obtainable, wherein the magnetic particles encode a very large amount of information within a very small space on the electrical component.

Thus, according to the present invention an electrical component having a densely distributed filament contact providing a very high redundancy of available point contacts is provided which is orders of magnitude greater than conventional metal to metal contacts. Further, a highly reliable low cost, long wearing electrical component that can be designed for serviceability which can be of controlled resistance, immune to contamination, nontoxic, and environmentally stable has been provided. It is capable of functioning for very extended periods of time in low energy configurations and can be used in high power applications. In addition, in the preferred embodiment the pultruded member can be cut into individual contacts and simultaneously fibrillated to provide a finished contact whose free fiber length can be closely controlled and the zone of demarcation between the pultruded portion and its free fibers well defined because the laser can be precisely controlled and focused in a programmable manner. Furthermore in addition to being capable of one step automated manufacturing the component can combine electrical function with mechanical or structural function.

As the magnetic material, particles of any shape, including blends of different shapes, are preferred. For the production of fine diameter conductive fibers, the magnetic particles preferably have a diameter of less than 20 microns, preferably less than 5 microns, and more preferably less than 1 micron. For example, the magnetic particles may have a diameter ranging from about 1 nm to about 10 micrometers.

The magnetic particles are magnetically responsive but can be electrically conductive, semiconductive, or nonconductive. Materials which are electrically conductive and magnetic, such as iron, cobalt, nickel, various metal oxides, ferrites and magnetic carbon black, may be used. Electrically semiconductive magnetic materials, such as some of the metal oxides of iron, and some ferrites, for example, may also be used, depending on the required conductivity. Electrically nonconductive magnetic materials may also be used in the present invention directly or by mixing them with electrically conducting materials to form composites or other intimate mixtures, such as, for example, materials with a core/shell structure wherein the core consists of a magnetic material and the shell consists of an electrical conductor. In addition, it is possible to use magnetic particles including an electrically conductive magnetic core having a shell of an electrically semiconductive or nonconductive material. Various embodiments are possible, and may be chosen according to the required electrical conductivity and magnetism. Polymeric shell materials that are either thermal plastic, such as nylon, polyester, acrylic, polypropylene, polyethylene, and the like, or, thermal setting such as epoxies, vinylester, polyester, and the like are preferred and are chosen to be compatible with the magnetic particulate material and the matrix resin and to be stable during the composite and device manufacturing operations and during end application use. Other shell materials are disclosed herein.

The magnetic particles are present in an amount ranging for example from about 0.01% to about 500% by weight of the starting polymer matrix which equals about 0.005% to about 30% of the weight of the electrical component, preferably from about 0.1% to about 20% by weight, based on the weight of the electrical component.

In general, all magnetic materials that are compatible with the matrix resin, are stable under compounding and device manufacturing processes and which show magnetization at the desired working temperature may be used. The magnetic strength of these materials, as measured by their magnetic saturation magnetization, in units of electromagnetic units per gram (emu/g), may vary from just above zero, that is, a few emu/g, up to, for example, iron, which has a saturation magnetization at room temperature of 210 emu/g. Thus, this range may include materials that are paramagnetic, which include salts of transition elements and salts and oxides of the rare earths; ferromagnetic, which include iron, cobalt, nickel and metal alloys; antiferromagnetic, which include some transition metal oxides, chlorides, fluorides, sulfides, chromium, alpha manganese and metal alloys; ferrimagnetic, which include cubic and hexagonal ferrites, maghemite, garnet and alloys; superparamagnetic, which include single domain nanoscale materials and clusters of paramagnetic ions; and materials that display other kinds of magnetism, such as metamagnetism, canted ferromagnetism, and any not already mentioned. Candidate materials may also include so called molecular magnets. In addition, the magnetic materials used may be magnetically hard or soft. The former possess large coercivity making it difficult to demagnetize the materials while the latter possess very low coercivity making it easy to demagnetize the material. Barium and strontium ferrites are examples of the former while elemental iron is an example of the latter.

Preferred electrically conductive, magnetic materials include, for example, iron containing carbon black, metal particles such as, for example, nickel, iron, cobalt, etc., oxides thereof, and mixtures thereof, as well as powders of the magnetic alloys such as permaloy, molybdenum permaloy and the like. Most preferably, the conductive particles comprise fine diameter (i.e., less than 1 micron) iron containing carbon black or iron powder. Suitable materials and fabrication processes for the magnetic particles are disclosed in Ziolo, U.S. Pat. No. 4,474,866 and Ziolo, U.S. Pat. No. 4,238,558, the disclosures of which are totally incorporated herein by reference.

In embodiments of the present invention, the magnetic particles, and the preparation methods for these magnetic particles, are those described in Ronald Ziolo, U.S. application Ser. No. 08/600,642, now U.S. Pat. No. 5,667,924, the disclosure of which is totally incorporated herein by reference, where the disclosed magnetic nanoparticles include a magnetic core and a polymeric material which at least partially covers the magnetic core, and preferably totally covers the magnetic core. The magnetic core may be a magnetic material described herein such as iron oxide like gamma $Fe_2O_3$. In the magnetic nanoparticles, the magnetic core may be present in an amount ranging from about 0.001 to about 60 weight percent and the polymeric material may be present in an amount ranging from about 40 to about 99.999 weight percent. The magnetic nanoparticles have a diameter in the nanometer range, preferably ranging from about 2 nm to about 100 nm, with a nominal average diameter of about 8 nm. The magnetic cores are believed to be completely or substantially free of magnetic memory.

The present invention provides a low cost, highly reliable, and effective means of employing magnetic forces to manipulate, actuate, move, or otherwise control the electrical component. Particularly important and provided by the present invention is the ability to control contact forces of the electrical contact to very low levels, such as between 1 to 30 grams, which is not readily nor reliably possible with conventional mechanical means, such as by the use of coil or leaf springs. Again referring to FIG. 8, we observe that the low contact loads to achieve the lowest levels of contact resistance are a feature of the distributed filament contact surfaces and that the contacts are capable of long term continuous operation under very light contact loads. This feature provides the contacts with very long operational lives because the mechanical forces which contribute to contact device failures are thereby minimized by use of the present invention. In embodiments, the magnetic particles contribute to the contact load of the electrical component with the another component when the magnetic particles are subjected to a magnetic field. Further, it provides a means to encode by use of magnetic recording information, such as date of manufacture codes, manufacturing process codes, manufacturer identification, raw materials' information and the like, directly upon or within the component.

The polymeric material of the nanoparticles can be any suitable organic or inorganic binder material, such as thermoplastic or thermoset resins, ion exchange resins, ion exchange metal oxides, such as silicon dioxide, which is capable of hosting the magnetic nanocrystalline particles. Other examples of materials useful for the polymeric material of the nanoparticles include ion exchangeable polymer resins such as sulfonated polystyrene resins and perfluorinated polysulfonic acid containing resins, and wherein the polymer resin is optionally crosslinked. A preferred resin is a polystyrene sulfonic acid (PSSA) ion exchange resin crosslinked from about 1 to 16% with divinylbenzene. More preferably, a 2 to 8% divinylbenzene crosslinked sulfonated polystyrene can be selected. Illustrative examples of suitable ion exchange resins include sulfonated and carboxylated polystyrenes, strongly acidic polyphenolics, polysulfonic acids prepared from monomers of the formula $R—CH_2—SO_3^-H^+$, weakly acidic polyacrylics with a pH of about, for example, 5 to 6, for example, polycarboxylic salts prepared from unsaturated monomers of the formula $R—COO^-Na^+$, wherein R is a polymerizable monomer with from 2 to about 20 carbon atoms, for example, unsaturated alkyl, alkylene, arylalkylene or arylalkyl groups, perfluorinated polysulfonic acids, weakly acidic chelating polystyrenes, and the like, with strongly acidic sulfonated polystyrenes and perfluorinated polysulfonic acid salts being preferred. In addition, anionic exchange resins such as Baker IONAC NA-38™, Baker IONAC A-554™, Dowex SBR™, AMBERLITE IRA-400™, AMBERLYST™, Dowex IX8-100™, and NAFION™ resins available from DuPont, may also be used.

The numbers used in indicating the diameter of the magnetic particles do not include the thickness of any polymeric material or coating on the magnetic particles and only indicates the size of the magnetic core since one can visually determine the magnetic core size, but not so easily for the thickness of the polymeric material, in part because the thickness may not be constant everywhere on the particles. The weight percent of the magnetic particles in the electrical component includes the magnetic core and any polymeric material on the magnetic core. In the magnetic particles, the polymeric material may have a thickness ranging for example from about 0.5 nm to about 10 nm.

Other modifications of the present invention may occur to those skilled in the art based upon a reading of the present disclosure and these modifications are intended to be included within the scope of the present invention.

We claim:

1. An electrical component having an axial direction and two ends for making electrical contact with another component, comprising a plurality of electrically conductive fibers in a matrix, the plurality of the fibers being oriented in the matrix in a direction substantially parallel in the axial direction of the component and being continuous from one end of the component to the other end to provide a plurality of electrical point contacts at each end of the component, wherein the electrical component further includes magnetic particles which are randomly dispersed.

2. The component of claim 1, wherein the magnetic particles contribute to the contact load of the electrical component with the another component when the magnetic particles are subjected to a magnetic field.

3. The component of claim 1, wherein the magnetic particles are included in a coating on a portion of the surface of the electrical component, wherein the magnetic particles encode information.

4. The component of claim 1, wherein one end of the component has an end region at least substantially free of the matrix to form a brush structure.

5. The component of claim 1, wherein the fibers are carbon fibers or carbonized polyacrylonitrile fibers.

6. The component of claim 1, wherein the matrix is a thermoplastic resin or a thermosetting resin.

7. The component of claim 1, wherein the fibers and the matrix are prepared by pultrusion.

8. The component of claim 1, wherein the fibers have an overcoating and the magnetic particles are present in the overcoating on the fibers.

9. The component of claim 1, wherein the magnetic particles are present in the fibers.

10. The component of claim 1, wherein the magnetic particles are present in the matrix.

11. The component of claim 1, wherein the magnetic particles are present in an amount ranging from about 0.005% to about 30% by weight based on the weight of the component.

12. The component of claim 1, wherein the magnetic particles have a diameter ranging from about 1 nm to about 10 micrometers.

13. The component of claim 1, wherein the magnetic particles are electrically conductive.

14. The component of claim 1, wherein the magnetic particles have a diameter of less than 1 micron and comprise a magnetic core and a polymeric material which at least partially covers the magnetic core.

15. The component of claim 1, wherein the magnetic particles are electrically nonconductive.

16. The component of claim 1, wherein the magnetic particles are electrically semiconductive.

17. An electrical component having an axial direction and two ends for making electrical contact with another component, comprising a plurality of electrically conductive fibers in a matrix, the plurality of the fibers being oriented in the matrix in a direction substantially parallel in the axial direction of the component and being continuous from one end of the component to the other end to provide a plurality of electrical point contacts at each end of the component, wherein the electrical component further includes magnetic particles which are electrically nonconductive.

* * * * *